United States Patent [19]

Steinhoff

[11] Patent Number: 4,945,850

[45] Date of Patent: Aug. 7, 1990

[54] LIGHT-WEIGHT ANCHOR

[76] Inventor: William Steinhoff, P.O. Box 953, St. Catharines, Ontario, Canada, L2R 6Z4

[21] Appl. No.: 324,765

[22] Filed: Mar. 17, 1989

[30] Foreign Application Priority Data

Dec. 30, 1988 [CA] Canada ..... 587324

[51] Int. Cl.[5] ..... B63B 21/34

[52] U.S. Cl. ..... 114/304; 114/294

[58] Field of Search ..... 114/294, 301, 1, 309, 114/298

[56] References Cited

U.S. PATENT DOCUMENTS

| | | | |
|---|---|---|---|
| 922,137 | 5/1909 | Hall | 114/304 |
| 2,320,966 | 6/1943 | Danforth | 114/309 |
| 2,354,666 | 8/1944 | Danforth | 114/309 |
| 3,270,704 | 9/1966 | Ekberg | 114/304 |
| 3,776,172 | 12/1973 | Lambert | 114/301 |
| 4,073,256 | 2/1978 | Rossini | 114/304 |
| 4,089,288 | 5/1978 | Van Den Haak | 114/304 |
| 4,134,355 | 1/1979 | Carruthers | 114/304 |
| 4,409,923 | 10/1983 | MacPherson | 114/304 |
| 4,655,158 | 4/1987 | Holder | 114/304 |

*Primary Examiner*—Joseph F. Peters, Jr.
*Assistant Examiner*—Edwin L. Swinehart
*Attorney, Agent, or Firm*—Krass & Young

[57] ABSTRACT

A very light-weight boat anchor includes a pair of penetrating flukes connected together, an anchor shank pivotally attached to this pair of flukes, and a mechanism for limiting the pivotal movement of the shank relative to the flukes. Both the flukes and the shank are made of light-weight alloy metal and the total weight of the anchor does not exceed 250 grams and is preferably less than 150 grams. The flukes include edge ribbing extending along upper and lower edges thereof and relatively thin metal webbing extending between this ribbing.

7 Claims, 1 Drawing Sheet

LIGHT-WEIGHT ANCHOR

BACKGROUND OF THE INVENTION

This invention relates to boat anchors and particularly the type of anchor having a pair of flukes.

Various types of boat anchors are known including fluke anchors which are particularly suited for a hard or medium-hard bottom. Anchors designed for use in a mud bottom often are provided with relatively wide, pointed flukes, pivotally supported by a cross head mounted on a shank. These flukes can penetrate a sand or mud bottom as the anchor is dragged across the bottom.

An anchor moors a vessel or boat to the lake or river bed, generally by its own weight and by hooking itself into the bottom. For this reason anchors have generally been reasonably heavy with the weight and size of the anchor being dependent to some extent on the boat on which it is to be used. The anchor is attached to the boat by a cable or rope which is generally secured at one end of the boat.

Many boats in use today are used for recreational purposes and are generally used in good weather. A common form of recreational vessel is a small, one or two person rubber raft. Often these rafts are used for sun bathing and not for "boating" in the normal sense. People using such rubber rafts are often in swimwear and, in many cases, they would not be wearing shoes that would provide some protection to their feet. Because of the nature of and the weight of standard boat anchors, they are not particularly suited for use with light recreational vessels such as rubber crafts. Many anchors and particularly fluke type anchors have reasonably sharp corners or points that can cut or puncture a rubber craft. Such known anchors are also capable of causing injury if dropped accidentally on a person's foot.

It is an object of the present invention to provide a light-weight boat anchor that is particularly suitable for use with rubber crafts or light boats and that is less likely to cause injury to the user if accidentally dropped.

It is another object of the invention to provide a light-weight anchor wherein all corners of the flukes are rounded and smooth so that the anchor is less likely to damage a rubber craft or boat.

SUMMARY OF THE INVENTION

According to one aspect of the invention, a very light-weight boat anchor comprises a pair of flukes connected together and an anchor shank pivotally attached to the pair of flukes. There are also motion limiting means for limiting the pivotal movement of the shank relative to the flukes. The flukes and shank are made of light-weight alloy metal and the total weight of the anchor does not exceed 250 grams.

According to another aspect of the invention a light-weight boat anchor comprises a fluke unit having a pair of flukes constructed to pivot together and an anchor shank pivotally attached to the fluke unit. A motion limiting mechanism limits the pivotal movement of the shank relative to the flukes. All corners of the flukes are rounded and smooth. Edge ribbing extends around the perimeter of both flukes including upper and lower edges thereof.

In the preferred anchor disclosed herein, relatively thin metal webbing extends between the edge ribbing.

Further features and advantages will become apparent from the following detailed description taken in conjunction with the accompanying drawings.

DETAILED DESCRIPTION OF PREFERRED EMBODIMENT

Figure 2:
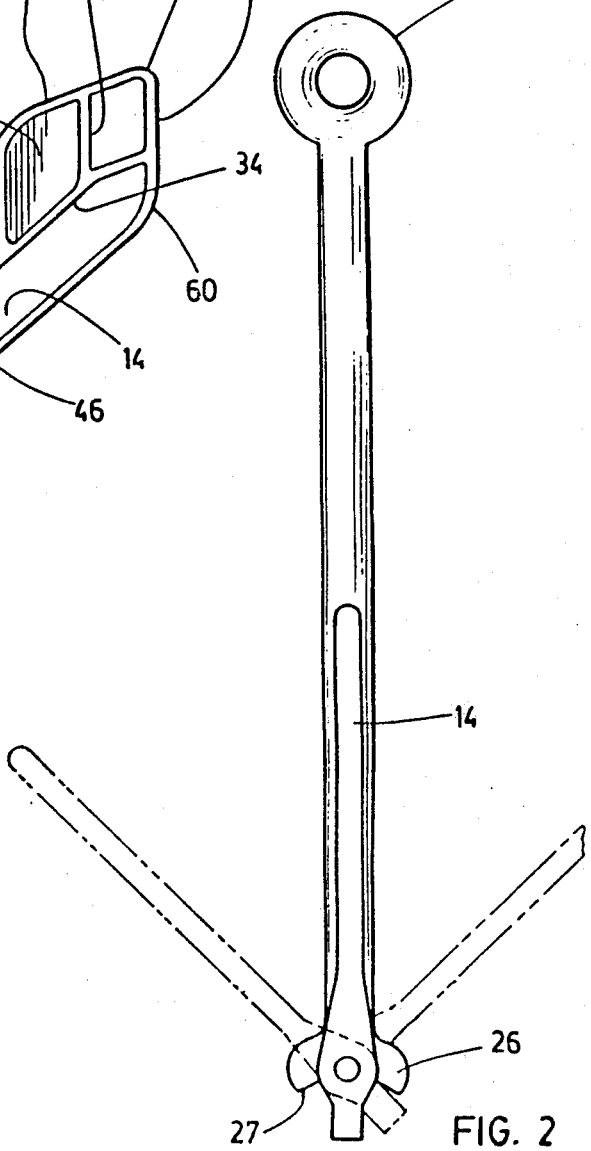
FIG. 2 is another side elevation of the anchor of FIG. 1 taken from the right side of FIG. 1 and illustrating how the flukes can move from one extremity to the other.

A light-weight boat anchor 10 includes a pair of flukes or wings 12 and 14 which are rigidly connected by an integral U-shaped bar 16 having rounded exterior corners 17 and 18. An elongate anchor shank 20 is pivotally attached to the pair of flukes by means of a pivot pin 22 located at the bottom end of the shank. At the top end of the shank is a suitable connecting eye 24 to which a rope or cable can be connected. Motion limiting means are formed on the bottom of the shank for limiting the pivotal movement of the shank relative to the flukes. In the preferred illustrated anchor there are two protrusions or stops 26 formed on opposite sides of the shank, each of which has a flat side 27 which is preferably positioned so that the maximum pivotal motion of the flukes is about 45 degrees to either side of the shank (as shown in FIG. 2).

Both the flukes and the shank are made of light-weight alloy metal such as aluminum alloy. These are preferably cast in a suitable mould. The complete anchor is painted with marine enamel. A preferred alloy is zinc aluminum (ZA-12) because of its ease of casting in permanent moulds and its high strength.

The flukes 12 and 14 preferably have edge ribbing 30 extending along upper and lower edges thereof and relatively thin metal webbing 32 extending between the edge ribbing. To increase the strength of each fluke, there is preferably additional internal ribbing including a central longitudinal rib 34 extending from the base of the fluke to about the outer end thereof. In the illustrated version of the anchor, there are three interconnecting ribs 36 which extend from the central rib 34 to the upper edge ribbing 30.

The flukes are constructed so as to snag and hold on a gravel or rocky bottom despite the light-weight of the anchor. The upper edge 40 of each fluke extends outwardly and upwardly from the bottom of the shank as illustrated. At least a major portion of the upper edge extends at an acute angle of at least 30 degrees to the anchor shank. In the illustrated anchor, this major straight section 42 of the upper edge extends at an angle of 34 degrees relative to the shank. Preferably each fluke has a straight lower edge 46 which extends at an angle relative to the shank in the 45° to 60 degree range. In the illustrated fluke, this lower edge extends at an angle of about 48 degrees relative to the shank.

The preferred anchor fluke is divided into the aforementioned straight major section 42 and a straight minor section 50 extending outwardly from the outer end of the major section at an acute angle thereto. In addition there is a short outside edge 52 extending between the upper and lower edges of the fluke. This edge 52 also has edge ribbing so that the edge is not sharp.

Figure 1:
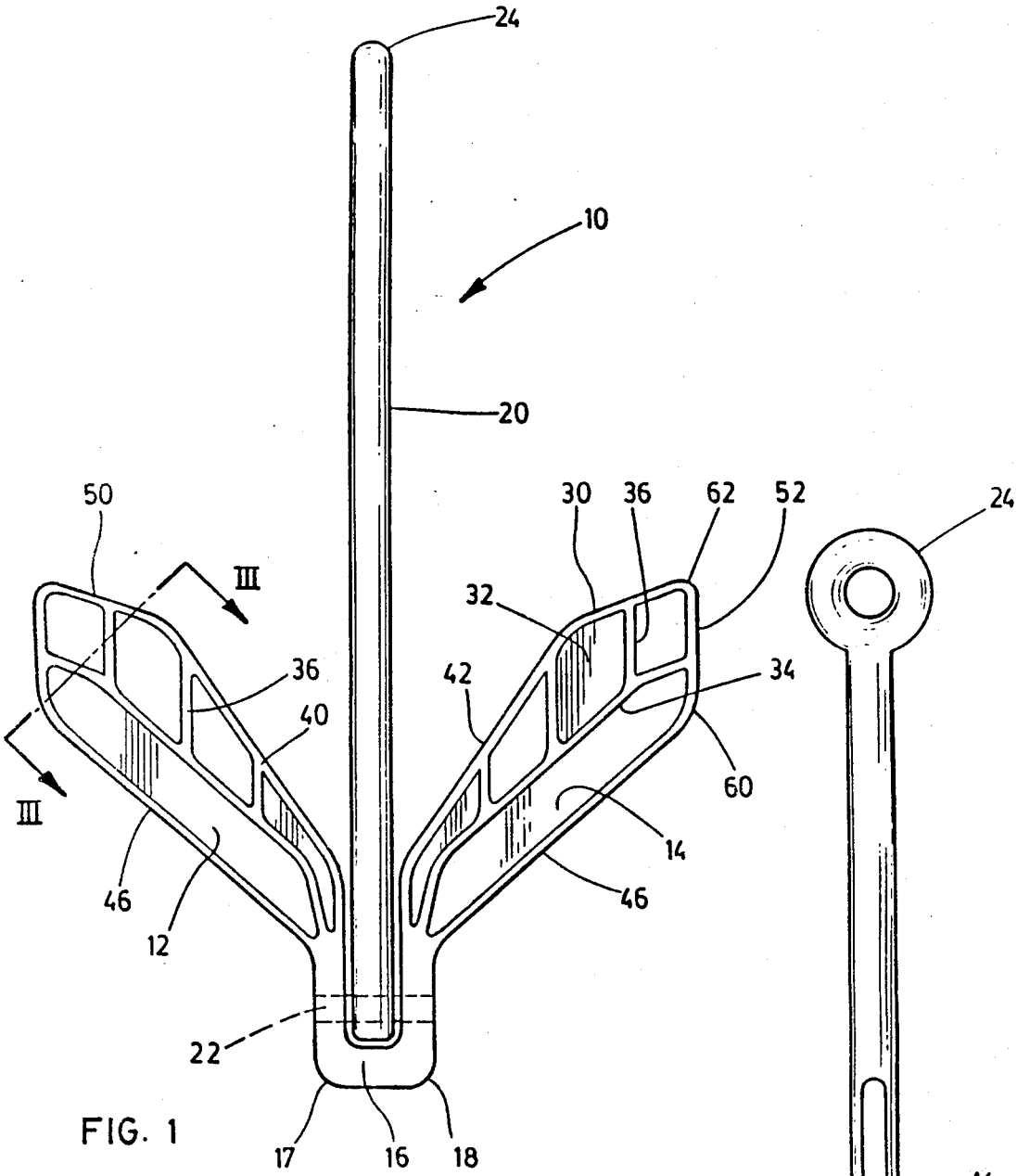
FIG. 1 is a side elevation of a boat anchor constructed in accordance with the invention.
Figure 3:
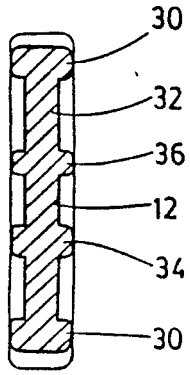
FIG. 3 is a cross sectional view taken along the line III—III of FIG. 1.

It will be particularly noted that all corners of each fluke are smooth and rounded including a corner 60 formed where the lower edge of the fluke meets the outside edge 52 and the outermost corner 62 where the upper edge meets the outside edge 52. Even the edge ribbing 30 is rounded as shown in FIG. 3.

In one preferred version of this anchor 10, the total width of the anchor is less than six inches and the height of the flukes is no more than five inches. In one particular version of the anchor the total length of the shank is about seven and three-quarter inches while the total height of the flukes including the connecting bar is only four inches.

The preferred form of pivot pin 22 is one made from strong stainless steel. This pin is preferably a split pin that is hollow and split on one side to allow a radial spring pressure. The pin is secured by its own spring tension when driven into its hole. The hole in the shank 20 is a clearance fit over the pin to allow the shank to pivot readily.

A particularly preferred version of the present anchor is very light in weight, having a weight of approximately 128 grams (about one quarter pound).

It will be clear to those skilled in the art of constructing anchors that various modifications and changes can be made to the anchor as described without departing from the spirit and scope of this invention.

Accordingly all such modifications and changes as fall within the scope of the appended claims are intended to be part of this invention.

I therefore claim:

1. A light-weight boat anchor comprising a pair of flukes connected together adjacent a bottom end portion of each of the flukes by an integral U-shaped bar, an anchor shank pivotally attached to said bar, and motion limiting means for limiting the pivotal movement of said shank relative to said flukes, each of said flukes having an upper edge which extends upwardly and outwardly from the bottom end portion of the fluke and at an angle of at least 30 degrees to said anchor shank, and wherein each fluke has a straight lower edge which extends outwardly and upwardly at an angle relative to said shank in the 45° to 60 degree range, said angles being measured when said flukes and shank are in a common plane.

2. A light-weight anchor according to claim 1 wherein said flukes include edge ribbing extending around the perimeter of both flukes including upper and lower edges thereof and relatively thin metal webbing extending between said edge ribbing.

3. A light-weight anchor according to claim 1 where the bottom end portion of each of the flukes are integrally connected to and extend from an arm of said U-shaped bar, each of said arms of said U-shaped bar having a hole bored therein, said anchor shank having a hole formed in a lower end portion and being secured to said U-shaped bar by means of a pivot pin which passes through the holes formed in said bar and shank.

4. A light-weight anchor according to claim 2 wherein each fluke has internal ribbing including a central longitudinal rib extending from the bottom end portion of said fluke to about the opposite outer end of the fluke.

5. A light-weight anchor according to claim 1, wherein each fluke has a short outside edge extending between said upper and lower edges.

6. A light-weight anchor according to claim 2 wherein all corners of each fluke are smooth and rounded.

7. A light-weight anchor according to claim 1 wherein said flukes each have an upper section which is generally wider than a lower section thereof.

* * * * *